United States Patent [19]

Agostino

[11] Patent Number: 4,841,580

[45] Date of Patent: Jun. 27, 1989

[54] BUOYANT AND NON-BUOYANT VALVE

[76] Inventor: Michael Agostino, 101-A Spring St., St. Augustine, Fla. 32084

[21] Appl. No.: 132,319

[22] Filed: Dec. 14, 1987

Related U.S. Application Data

[63] Continuation-in-part of Ser. No. 25,374, Mar. 13, 1987, abandoned, and a continuation-in-part of Ser. No. 940,746, Dec. 12, 1986, abandoned, and a continuation-in-part of Ser. No. 30,369, Mar. 26, 1987.

[51] Int. Cl.[4] ..... E03D 1/34

[52] U.S. Cl. ..... 4/393; 4/402; 4/404

[58] Field of Search ..... 4/324–327, 4/392, 393, 395, 402–404; 137/329.04

[56] References Cited

U.S. PATENT DOCUMENTS

| | | | |
|---|---|---|---|
| 673,762 | 5/1901 | Crabb | 4/392 X |
| 1,286,791 | 12/1918 | Saal | 4/404 |
| 1,668,803 | 5/1928 | Cigol et al. | 4/403 |
| 1,946,266 | 2/1934 | Becker | 4/402 |
| 2,598,967 | 6/1952 | Bennett | 4/392 |
| 3,702,012 | 11/1972 | Bennett | 4/392 |
| 3,707,733 | 1/1973 | Gore et al. | 4/393 |
| 4,122,564 | 10/1978 | Addicks et al. | 4/326 |
| 4,189,795 | 2/1980 | Conti et al. | 4/324 |

*Primary Examiner*—Charles E. Phillips

[57] ABSTRACT

A flush valve for use in a flush tank for control by the operator of the amount used in flushing, the valve including an elongate body having a solid generally hemispherical protuberance extending outwardly on one side and a hollow frusto-conical cup member extending outwardly from the other side. A tab and opening therethrough on the forward portion of the body for connection to the valve operating system allows the valve to be alternatively turned with the cup member facing upward and being non-buoyant or having the cup member facing downwardly whereby air trapped therein renders the valve buoyant for substantially a full flush. Spaced arm members extend laterally from the rearward portion of the valve body and have one or more openings pivotally mounting the valve to the normal overflow tube to position the valve with respect to the water outlet in either selected position.

14 Claims, 2 Drawing Sheets

BUOYANT AND NON-BUOYANT VALVE

RELATION TO PRIOR APPLICATIONS

This is a continuation-in-part of U.S. patent application "The Water Gate Flapper", Ser. No. 025,374, filed Mar. 13, 1987, now abandoned and a continuation-in-part of "Solid Heavy Flap Cover", Ser. No. 940,796, filed Dec. 12, 1986, now abandoned and a continuation-in-part of "Dual Flush Valve Assembly", Ser. No. 030,369, filed Mar. 26, 1987.

BACKGROUND OF THE INVENTION

1. FIELD OF THE INVENTION

The present invention relates to flush tank control apparatus for a toilet and particularly to valves that may be buoyant and non-buoyant depending upon how the valve is attached to the valve operating system.

2. PRIOR ART

Flap valves and similar flow control devices for use with flush tank control apparatus are well known in the prior art. Specifically, there are several devices that are in use that are buoyant for allowing the full flush cycle to take place when the valve operating system handle is operated. In addition, there are non-buoyant valves used for partial flushes, more accurate control of water uses, and ease of quick shutoff of water if backup occurs in the flush system. Other devices used to limit the water used in a flush operation include dualmode devices which have a partial flush and a full flush mode; water column devices which have dams or other partition devices which can prevent a full flush when needed; and devices which allow for premature closing the flush valve. These devices all suffer from significant disadvantages such as complexity and the fact that they can only be used in specific applications. The present invention provides that the valve can be used in a system where a buoyant valve is desired or it can simply be turned over and used as a non-buoyant valve if so desired. Furthermore, many devices in the prior art are not adaptable for use with different heights and valve seat angles with respect to the overflow pipe which is used with pivot connections on the valve for operation. Many valves provide for two rearwardly extending arms that are connected to the overflow pipe. It is very important that the valve design make provision for adequate sealing with different seating angles and to do so with the valve used in a buoyant or non-buoyant configuration. Thus, the present invention overcomes the attachment disadvantages of devices in the prior art, illustrated by U.S. Pat. No. 3,702,012. Finally, the design of the valve in accord with the present invention is self-centering and accordingly positive seating is assured in either the buoyant or non-buoyant state of the valve unlike any other known prior art valve.

SUMMARY OF THE INVENTION

In accord with an aspect of the present invention, a buoyant and non-buoyant flush tank valve for use in a flush tank has a selective valve operating means for moving the valve, a water inlet, a water outlet with a valve seat thereat selectively closeable by the valve and an upstanding overflow pipe adjacent the water outlet. The improved valve includes an elongated base with opposite end portions, the base having at one of its end portions an attachment means for connection to the valve operating means for moving the valve to a first position in which the valve is closed on the valve seat.

The base has at its opposed end portion a means for mounting the valve onto the overflow pipe for movement between the first and second positions. The elongate base has opposite generally planar sides and a generally vertically extending hollow frusto-conical cup member on one of the sides and an oppositely disposed generally hemispherical protuberance on the other side. The cup member is disposed downwardly when the flush valve is mounted in a buoyant position and is disposed within the water outlet when the flush valve is in the second position. The cup member is disposed upwardly when the flush valve is mounted in a non-buoyant position with the protuberance being disposed within the water outlet when the flush valve is in the second position.

Other aspects of the invention are seen wherein the attachment means includes a forwardly extending tab on the base and an opening therethrough. The means for mounting the valve includes pivotable means for attachment to the overflow pipe and the pivotable means includes at least two spaced openings for adjusting the angle of the valve when the valve is in the second position, the opening being formed in the other end portion and located in generally vertical alignment. Preferably, the other end portion of the base includes a pair of laterally disposed arms integral with the extending rearwardly from the one end portion, each of the arms has an opening therethrough and forming the pivotable means for pivotally mounting the valve. Each arm has at least two spaced openings for adjusting the angle of the valve when the valve is in the second position, the openings on each arm being formed and located in generally vertical alignment.

The generally hemispherical protuberance on the opposite side from the cup member is substantially symetrical about the vertical axis passing through the cup member and the protuberance. When the flush valve is mounted in a non-buoyant position the cup member is disposed upwardly and the protuberance is disposed within the water outlet when the flush valve is in the second position. The cup member has a cavity therein communicating through a passageway with either water or air depending on alternate mounting of the valve in the respective non-buoyant and buoyant positions. The cup member is filled with water when the cup member passageway is disposed above the body to increase the weight thereof for enhanced closure of the valve on the water outlet seat upon the operator's release of the selective valve operating means. The cup is filled with air when the cup member passageway is disposed below the body to prevent closure of the valve upon the operator's release of the selective valve operating means until the water level in the flush tank drops to generally the level of the water outlet.

In another aspect of the present invention, each of the arms has a single opening therethrough forming the pivotable means. The use of one or two spaced openings for adjusting the angle of the valve when the valve is in the second position insures proper seating thereof onto a valve seat. The planar surfaces may be angled toward each other adjacent one end portion or they may be substantially parallel in accord with various embodiments of the invention.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
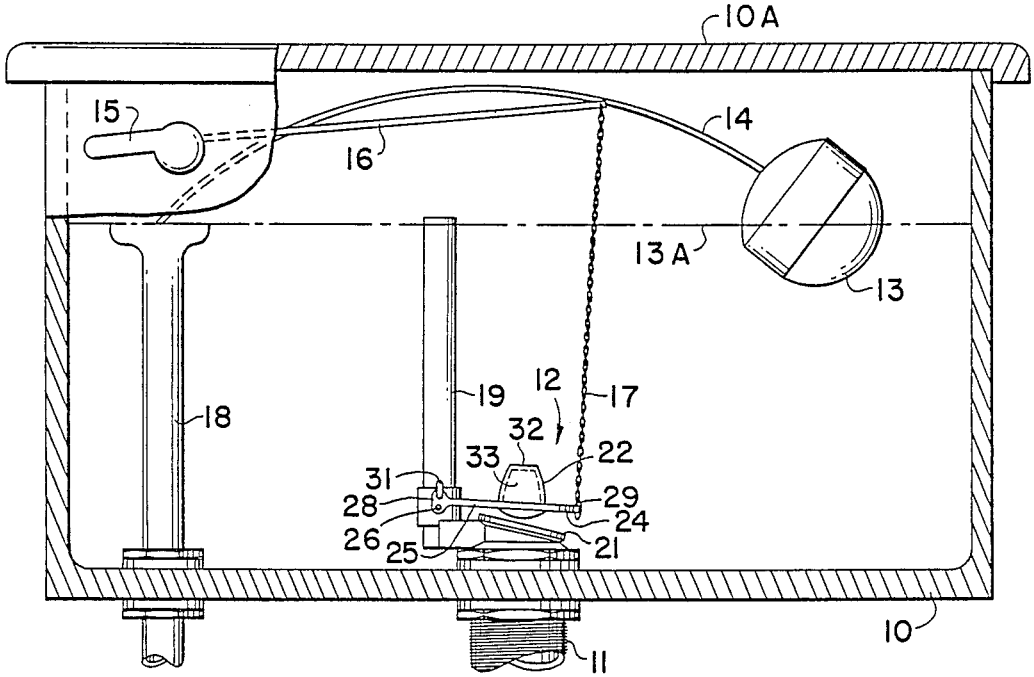
FIG. 1 is a cross-section of a flush tank utilizing the improved valve in accord with the first and preferred embodiment of the present invention connected in the non-buoyant position.
Figure 2:
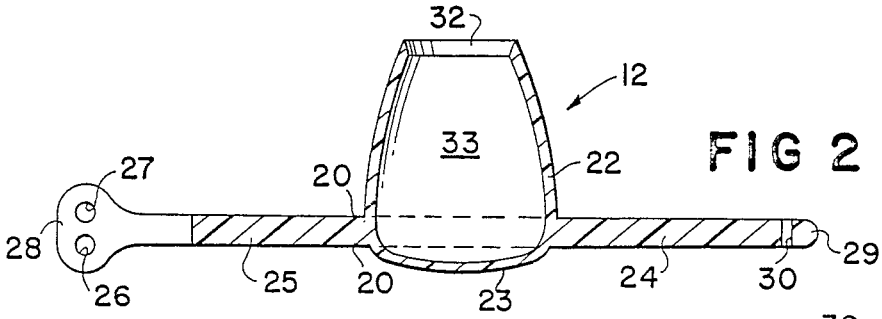
FIG. 2 is a cross-section of the valve shown in FIG. 1.

Referring now to the drawings of FIGS. 1 and 2, a cross-section of a flush tank 10 with removable lid 10*a* is shown in FIG. 1 water flow through the outlet pipe 11 is controlled by the improved valve 12, positioned as a non-buoyant valve, in accord with the present invention. As is well understood in the art, float ball 13 resting upon water level 13A, is connected to float control arm 14 for operating a tank refill valve (not shown) in response to actuation of handle 15 which initiates a flushing operation via valve control arm 16 and 17 to lift valve 12 in the usual manner. Water is supplied to the tank 10 via inlet pipe 18. Upstanding overflow pipe 19 is located adjacent outlet pipe 11 and functions in the conventional manner.

Flap valve 12, according to this invention, is comprised of an elongate body or base 20 having a forward portion 24 and a rearward arm portion 25. The valve 12 rests upon outlet seat 21 when water flow through outlet pipe 11 is shutoff. The valve body 20 is preferably a solid single piece of rubber or similar resilient material that is shaped to provide a leak-tight seal when resting on seat 21. The valve 12 in FIG. 1 is shown in a non-buoyant configuration with hollow frusto-conical cup member 22 facing upwardly. Cup member 22 has opening 32 for receiving water in the interior cavity 33 and rendering the valve 12 non-buoyant. In this configuration the valve 12 will close quickly on seat 21 when tension on chain 17 is relaxed by release of handle 15 by the operator.

The lower generally hemispherical protuberance 23 is formed integrally with body 20 and acts to self-center the valve 12 when it is falling onto seat 21. The rearward arm portion 25 includes a pair of laterally disposed and spaced arms 25' that extend rearwardly from central body portion 20. Each arm has an identical rearward end 28 with two vertically spaced openngs 26 and 27 therethrough for pivotally mounting the valve 12 onto overflow pipe 19. As illustrated in FIG. 1, the openings 26 and 27 provide different mounts into which two diametrically-opposed elbow-shaped support pins 31 fit for quick and easy installation of the valve 12. Generally, pins 31 are fixed to or formed integrally with pipe 19 which is presently often made of plastic. The thin shape of the arms 25 on valve 12 is shown in plan in FIG. 5 which span on either side of pipe 19 with the upper pair of openings 27 receiving respective pins 31 which provide for a horizontal pivot axis for valve 12 to be lifted.

Means for selectively connecting the valve 12 to the chain 17 with either cup member 22 or lower protuberance 23 facing upward is comprised of an outwardly extending tab 29 with opening 30 therethrough. The tab is located on the forward portion 24 of the valve body 20 as clearly illustrated in FIG. 5.

Figure 3:
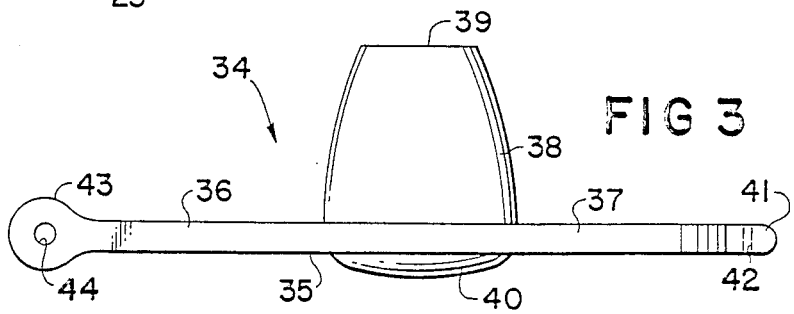
FIG. 3 is a side elevational view of a second embodiment of the valve in accord with the present invention.
Figure 4:
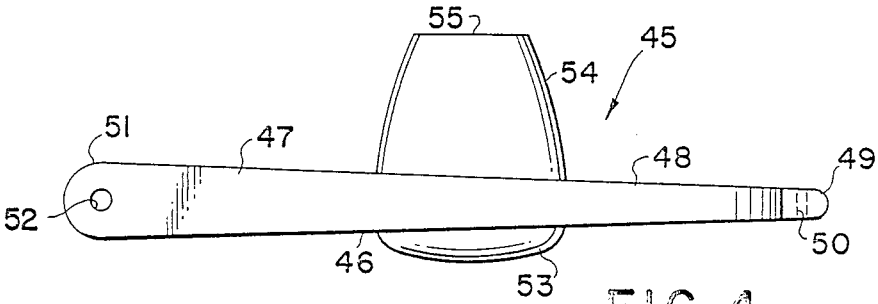
FIG. 4 is a side elevational view of a third embodiment of the valve in accord with the invention.
Figure 5:
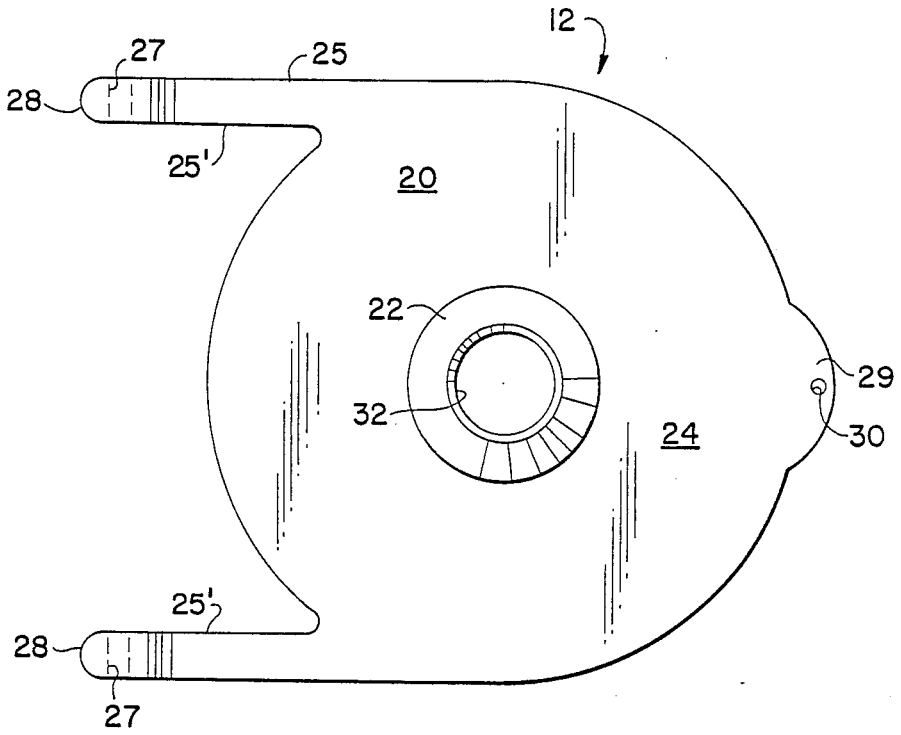
FIG. 5 is a top plan view of the valve illustrated in FIGS. 1 and 2, it being understood that the top plan views of FIGS. 3 and 4 are substantially identical thereto and all the rearward spaced arms of the valves of FIGS. 1-4 are generally the same in plan as such arms depicted in FIG. 5.
Figure 6:
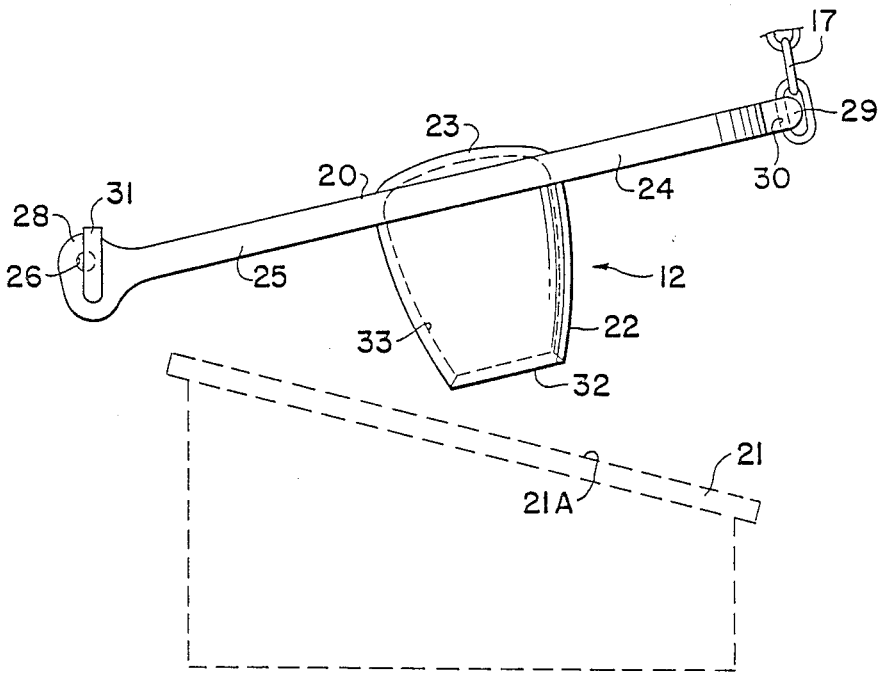
FIG. 6 is a side elevational view of the valve of FIG. 1 connected to the valve operating system as a buoyant valve.

The preferred embodiment of the invention accordingly is the valve 12, shown in FIGS. 1, 2, and 5, with at least two openings 26 and 27 in the end 28 of arms 25 so that different angled valve seats may be accomodated as well as to permit proper placement of the valve in either non-buoyant or buoyant positions shown in respective FIGS. 1 and 6. The second embodiment according to the invention is illustrated in FIG. 3 wherein valve 34 has a base or body 35 with forward portion 37 and rearward arm portions 36. Lower protuberance 40 is used for self centering when the valve 34 is used in a non-buoyant position with cup member 38 facing upward with water entering it via opening 39. Selective attachment of the valve 34 to the chain 17 is via opening 42 in tab 41. Unlike valve 12, valve 34 has only one opening 44 in arm terminus 43. In many applications of the valve 12 or 34, as a replacement component, it may be desirable to employ valve 12 because the support pins 31 may be integral to pipe 19 and therefore fixed in position with respect to seat 21. Also, in different tanks 10 the angle of the valve seat 21 is designed to coincide with the height of support pins 31 on pipe 19. The present invention employs valves, such as 12, with arms, such as 25', of sufficient resiliency to ensure adequate seating whether the valve is mounted via opening 26 or 27.

As illustrated in FIG. 6, the valve 12 can be used as a buoyant valve by simply turning it over so that cup member 22 is facing downwardly. Air will be trapped within interior cavity 33 which has sufficient displacement to render valve 12 buoyant. Similar arrangements are possible with valve 34 and 45.

Valve 45 in accord with the third embodiment of the invention, includes elongate body or base 46 with rearward arm portion 47 and a forward portion 48 having a tab 49 with an opening 50 therethrough for selective connection to chain 17. Ends, including end 51 of arms 47 have respective openings, including openings 52, therethrough for pivotally mounting the valve 45 on pins 31. The body 46 is tapered to be thinner at the forward portion 48 to permit proper seating on a seat 21.

Both of the valves 34 and 45 have the same general shape in plan as the valve 12 in FIG. 5. That is, the valves 12, 34, and 45 have two arm members corresponding generally to arms 25' integral with an elongate body corresponding to body 20. In all of the valves 12, 34, and 45 the density and weight of the material used in making such valves is sufficient to enable the valve to be non-buoyant when the respective cup member is filled with water but still allow such valve to be buoyant when the respective cup member is positioned downwardly as illustrated in FIG. 6 for valve 12.

In operation, handle 15 is depressed and the valve 12 is opened via chain 17 connected to tab 29. In a non-buoyant configuration, the weight and density of the valve body 20 will cause the valve 12 to remain open only as long as handle 15 remains depressed by the operator to the open position. As soon as handle 15 is released by the operator the valve 12 will rapidly close onto seat 21 stopping the water flow. Accordingly, the amount of water used can be controlled with great accuracy by the operator with the result that, in the long run, less water is used and the valve 12 can be rapidly closed in the event of backup in the flush bowl. Also, the valve is less likely to be stuck in an open condition and/or improperly seated to its valve seat.

Valve 12 can also be used in a buoyant position with cup member 22 facing downwardly. Cup member 20 has a generally frusto-conical shape to fit within the space 21*a* surrounded by seat 21 leading into outlet pipe 11 thus allowing for a self-centering secure seal on seat 21 between it and valve body 20. In the buoyant configuration, valve 12 operates to remain open until the water level 13*a* drops to near the bottom of tank 10 as well understood in the art.

In summary, a unitary buoyant and non-buoyant flush tank valve 12 is provided for use in a flush tank 10 having a selective valve operating means for moving the valve 12, a water inlet 18, a water outlet 11 with a valve seat 21 thereat selectively closeable by the valve 12 and an upstanding overflow pipe 19 adjacent the water outlet 11. The valve 12 comprises an elongated body 20 with opposite end portions 24, 25, the body 20 including attachment means 29, 30 at one of its end portions 24 for connection to the selective valve operating means for moving the valve 12 to a first position in which the valve 12 is open and a second position in which the valve 12 is closed on the valve seat 21 of the water outlet 11, for detachable connecting the valve 11 onto the overflow pipe 19 for movement between the first and second positions. The body 20 having opposite generally planar sides, and including a generally vertically extending hollow frusto-conical cup member 22 having a cavity 33 therein and located on one of the planar sides, the valve 12 including a generally hemispherical protuberance 23 on another of the planar sides oppositely disposed from and substantially symetrical about a vertical axis passing through the cup member 22 and the protuberance 23. The flush valve 12 is mounted in a buoyant position with the cup member 22 disposed downwardly and within the water outlet 21A when the flush valve 12 is in the second position with the cup member 22 being disposed upwardly and the protuberance 23 being disposed within the water outlet 21A when the flush valve is in the second position. The cup member 22 having a cavity 33 therein communicating through a passageway 32 with either water or air depending on alternate mounting of the valve 12 in the respective non-buoyant and buoyant positions, the cup member 23 being filled with water when the cup member passageway 32 is disposed above the body 20 to increase the weight thereof for enhanced closure of the valve on the water outlet seat 21 upon operator's release of the selective valve operating means, and the cup 22 being filled with air when the cup member passageway 32 is disposed below the body 20 to prevent closure of the valve upon operator's release of the selective valve operating means until the water level 13A in the flush tank 10 drops to generally the level of the water outlet at seat 21.

Valve 12 is illustrated in FIG. 2 as having a flared end 28 in a rearward portion. This particular design allows for sufficient material strength around pivot openings 26 and 27 while allowing for a relatively thin cross-section of the body 10. This not only reduces material costs but allows for sufficient strength and resiliency in arms 25 to provide adequate sealing on seat 21 when using different alignments of support pins 31 and valve seat 21 as discussed herein. Valves 34 and 45 operate identically to valve 12 in either a buoyant or non-buoyant configuration depending upon what is desired in the circumstances.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A buoyant and non-buoyant flush tank pivoting type valve for use in a flush tank having a selective valve operating means for moving said valve, a water inlet, a water outlet with a valve seat thereat selectively closeable by said valve and an upstanding overflow pipe adjacent the water outlet said valve comprising an elongated base with opposite end portions, said base having at one of its said end portions attachment means for connection to a valve operating means for moving said valve to a first position in which said valve is open and a second position in which said valve is closed on the valve seat, said base having at another of said end portions means for mounting said valve onto the overflow pipe for movement between said first and second positions, said elongate base having opposite generally planar side surfaces said surfaces being interrupted only on one side surface by a extending hollow frusto-conical cup member extending generally normal to said one side surface and only on the other side surface by an oppositely disposed generally hemispherical protuberance, said cup member being disposed downwardly when said flush valve is mounted in a buoyant position and being disposed within the water outlet when said flush valve is in said second position and said cup member being disposed upwardly when said flush valve is mounted in a non-buoyant position with said protuberance being disposed within the water outlet when said flush valve is in said second position said frusto-conical shape of said cup and said hemispherical shape of said protuberance each serving as valve self-centering members when either comes into contact with said valve seat.

2. The valve as defined in claim 1 wherein said attachment means includes a forwardly extending tab on said base and an opening therethrough for connection to said valve operating means.

3. The valve as defined in claim 1 wherein said means for mounting said valve includes pivotable means for attachment to said overflow pipe.

4. The valve as defined in claim 3 wherein said pivotable means includes at least two spaced openings for adjusting the angle of said valve when said valve is in said second position, said opening being formed in said other end portion and located in generally vertical alignment.

5. The valve as defined in claim 3 wherein said other end portion of said base includes a pair of laterally disposed arms intergral with and extending rearwardly from said one end portion, each of said arms having an opening therethrough and forming said pivotable means for pivotally mounting said valve.

6. The valve as defined in claim 5 wherein each said arm has at least two spaced openings for adjusting the angle of said valve when said valve is in the second position, said openings on each arm being formed and located in generally vertical alignment.

7. A unitary buoyant and non-buoyant flush tank pivoting type valve for use in a flush tank having a selective valve operating means for moving said valve, a water inlet, a water outlet with a valve seat thereat selectively closeably by said valve and an upstanding overflow pipe adjacent the water outlet, said valve comprising an elongated body with opposite end portions, said body including attachment means at one of its said end portions for connection to the selective valve operating means for moving said valve to a first position in which said valve is open and a second position in which said valve is closed on the valve seat of the water outlet, means for detachably connecting said vlave onto the overflow pipe for movement between said first and second positions, said body having opposite generally planar side surfaces said surfaces being interrupted only on one side by a generally vertically extending said valve including a hollow frusto-conical cup member extending generally normal to said one side surface and having a cavity therein, said valve including a generally hemispherical protuberance on the other of said planar side surface oppositely disposed from and substantially symmetrical about a vertical axis passing through said cup member and said protuberance, said flush valve being mounted in a buoyant position with said cup member disposed downwardly and within the water outlet when said flush valve is in said second position, said flush valve being mounted in a non-buoyant position with said cup member being disposed upwardly and said protuberance being disposed within the water outlet when said flush valve is in said second position said cup member having a cavity therein communicating through a passageway with either water or air depending on alternate mounting of said valve in the respective non-buoyant and buoyant positions, said cup member being filled with water when said cup member passageway is disposed above said body to increase the weight thereof for enhanced closure of said valve on the water outlet seat upon operator's release of the selective valve operating means, said cup being filled with air when said cup member passageway is disposed below said body to prevent closure of said valve upon operator's release of the selective valve operating means until the water level in the flush tank drops to generally the level of the water outlet said frusto-conical shape of said cup and said hemispherical shape of said protuberance each serving as valve self-centering members when either comes into contact with said valve seat.

8. The valve as defined in claim 7 wherein said attachment means includes a forwardly extending tab on said body and an opening therethrough for connection to the valve operating means.

9. The valve as defined in claim 7 wherein said mounting includes pivotable means for attachment to the overflow pipe.

10. The valve as defined in claim 9 wherein said pivotable means includes at least two spaced openings for adjusting the angle of said valve when said valve is in said second position, to insure proper seating thereof onto the valve seat, said openings being formed in said other end portion and located in generally vertical alignment.

11. The valve as defined in claim 9 wherein said other end portion of said body includes a pair of laterally disposed arms integral with and extending rearwardly from said on end portion, each of said arms having an opening therethrough and forming said pivotable means for pivotally mounting said valve.

12. The valve as defined in claim 11 wherein each said arm has at least two spaced openings for adjusting the angle of said valve when said valve is in said second position to insure proper seating thereof onto the valve seats said openings on each arm being formed and located in generally vertical alignment with said openings on respective arms being in generally horizontal alignment.

13. The valve as defined in claim 7 wherein said planar surfaces are angled toward each other adjacent said one end portion.

14. The valve as defined in claim 7 wherein said planar surfaces are substantially parallel.

* * * * *